US006680587B1

(12) United States Patent
Trestman et al.

(10) Patent No.: US 6,680,587 B1
(45) Date of Patent: Jan. 20, 2004

(54) ELECTRONIC BALLAST WITH ADAPTABLE CHARGE PUMP POWER FACTOR CORRECTION

(75) Inventors: Grigoriy A. Trestman, Salem, MA (US); Joseph L. Parisella, Beverly, MA (US); Richard H. Koeppl, Topsfield, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/261,029

(22) Filed: Sep. 30, 2002

(51) Int. Cl.[7] ..... H05B 37/02

(52) U.S. Cl. ..... 315/291; 315/209 CD; 315/312

(58) Field of Search ..... 315/291, 224, 315/225, 312, 316, 318, 324, 209 R, 209 CD, 219, 247

(56) References Cited

U.S. PATENT DOCUMENTS 5,469,028 A * 11/1995 Nilssen ..... 315/291
6,316,883 B1 * 11/2001 Cho et al. ..... 315/247
6,555,973 B2 * 4/2003 Kuisma ..... 315/291
6,577,077 B2 * 6/2003 Hu et al. ..... 315/291

* cited by examiner

*Primary Examiner*—Wilson Lee
(74) *Attorney, Agent, or Firm*—Kenneth D. Labudda

(57) ABSTRACT

A ballast (20') for powering a plurality of gas discharge lamps (12,14,16) includes a load-adaptable charge pump power factor correction arrangement (62,64,66,100,200,300) for feeding back a high frequency current having a magnitude that is dependent on the number of operating lamps.

16 Claims, 3 Drawing Sheets

ELECTRONIC BALLAST WITH ADAPTABLE CHARGE PUMP POWER FACTOR CORRECTION

FIELD OF THE INVENTION

The present invention relates to the general subject of circuits for powering discharge lamps. More particularly, the present invention relates to an electronic ballast with adaptable charge pump power factor correction.

BACKGROUND OF THE INVENTION

Fluorescent lighting systems are used extensively in industrial facilities and office buildings. Usually, there is more than one lamp in each lighting fixture, and one ballast powers each of those lamps. In a typical large building, the number of lighting fixtures can be in the hundreds or even thousands. Although the amount of power drawn by each ballast is low (e.g., less than 150 watts), the total amount of power consumed by the fluorescent lighting in a single building can reach in the tens of kilowatts. Such a large load can create a negative effect on the AC line, and potentially cause malfunction in sensitive electrical devices such as computers, lab equipment, and medical devices. In order to avoid such effects, there are rather high standards regarding the "quality" of the power (and, thus, the current) drawn by ballasts from the AC line. These standards are embodied in a number of front-end performance requirements, including high power factor (PF), low harmonic distortion (HD), and low line-conducted electromagnetic interference (EMI).

There are three main circuit approaches for providing the desired front-end performance in an electronic ballast. Each has significant shortcomings.

First, there is the "passive" power factor correction (PFC) approach. The circuitry in this approach consists essentially of an iron choke. The choke, which has a high inductive impedance at the AC line frequency (e.g., 60 hertz), typically provides a power factor of greater than 0.95 and a total harmonic distortion of less than 20%. With the addition of "X" and "Y" capacitors, this approach provides EMI suppression as well. The shortcomings of this approach are high cost, large physical size, and high power dissipation.

A second approach is commonly referred to as "active" power factor correction, which is usually realized by a high frequency boost type converter comprising a MOSFET switch, a small ferrite inductor, and control circuitry for the MOSFET switch. Additionally, a small common-mode ferrite inductor with X and Y capacitors is required for EMI suppression. This approach provides close to unity power factor and a total harmonic distortion of less than 10%. An additional benefit of this approach is that the DC bus voltage (i.e., the voltage provided at the output of the boost converter) remains constant over relatively wide variations in input voltage or load. The shortcomings of this approach include complex circuitry and high material cost.

A third approach is commonly referred to as "charge pump" power factor correction (PFC), wherein high frequency current from the ballast inverter or output is fed back to the front-end portion of the ballast. In its simplest form, a charge pump circuit consists of a single diode and capacitor; like the two approaches previously described, this approach requires additional circuitry for EMI suppression. Properly designed and implemented, a charge pump circuit can provide front-end performance comparable to that of a boost converter (e.g., close to unity power factor and less than 10% total harmonic distortion), but with considerably less cost, complexity, and physical size.

FIG. 1 schematically illustrates a prior art ballast with a charge pump arrangement. The ballast 20 includes: an EMI filter 40; a full-wave diode bridge 42,44,46,48; a charge pump circuit consisting of inductor 60, capacitor 62, and diode 52; an energy-storage capacitor 58; and a half-bridge inverter 70 that includes two series-connected transistors 72,74 coupled at a junction 76. The ballast is connected to the AC line source 10 via input connections 22,24, and to a fluorescent lamp 12 via output connections 26,32. During operation, the charge-pump circuit works in conjunction with the inverter to increase the power factor of the current drawn from AC line source 10 by injecting an amount of high frequency current from the inverter into the junction between diode bridge 42,44,46,48 and diode 52. This injection of current also acts to boost the DC bus voltage across capacitor 58; the DC bus voltage is dependent on the inverter operating frequency, the capacitance of capacitor 58, and the energy consumed by lamp 12. During steady-state operation, there is a balance between the energy provided by the charge pump (to energy-storage capacitor 58) and the energy consumed by the load (i.e., lamp 12).

A major shortcoming of charge pump circuits lies in the fact that the DC bus voltage is strongly dependent on the load power. More specifically, the DC bus voltage will tend to increase as the load decreases. For example, in the case of removal or failure of lamp 12 (or, in a ballast that power multiple lamps, the removal or failure of even one lamp), the DC bus voltage will jump to an unacceptably high level, which can lead to inverter failure. Thus, ballasts with charge pump circuits necessarily include special protection circuitry for dealing with lamp removal/failure.

Known ballasts with charge pump PFC are intended to work with only one or two lamps connected in series. In the case of lamp removal/failure, a shutdown circuit stops ballast operation. This type of ballast is widely used in the European market, and ballast shutdown in the event of lamp removal/failure is a required feature in Europe.

By contrast, in the North American market, the most widely used ballasts operate anywhere from two to four lamps connected in parallel. Because it is expected that the ballast will continue to operate even if some (but not all) of the lamps fail or are removed, a complete shutdown of the ballast in the event of removal/failure of some of the lamps is not an acceptable option.

What is needed, therefore, is a ballast with charge pump power factor correction that accommodates multiple parallel-connected lamps and that, in the event of removal/failure of some of the lamps, continues to provide power to the remaining lamps without harm to the ballast. A further need exists for a ballast that realizes the aforementioned functionality in an efficient and cost-effective manner. Such a ballast would represent a significant advance over the prior art.

DETAILED DESCRIPTION OF THE PREFERRED EMBODIMENTS

Figure 1:
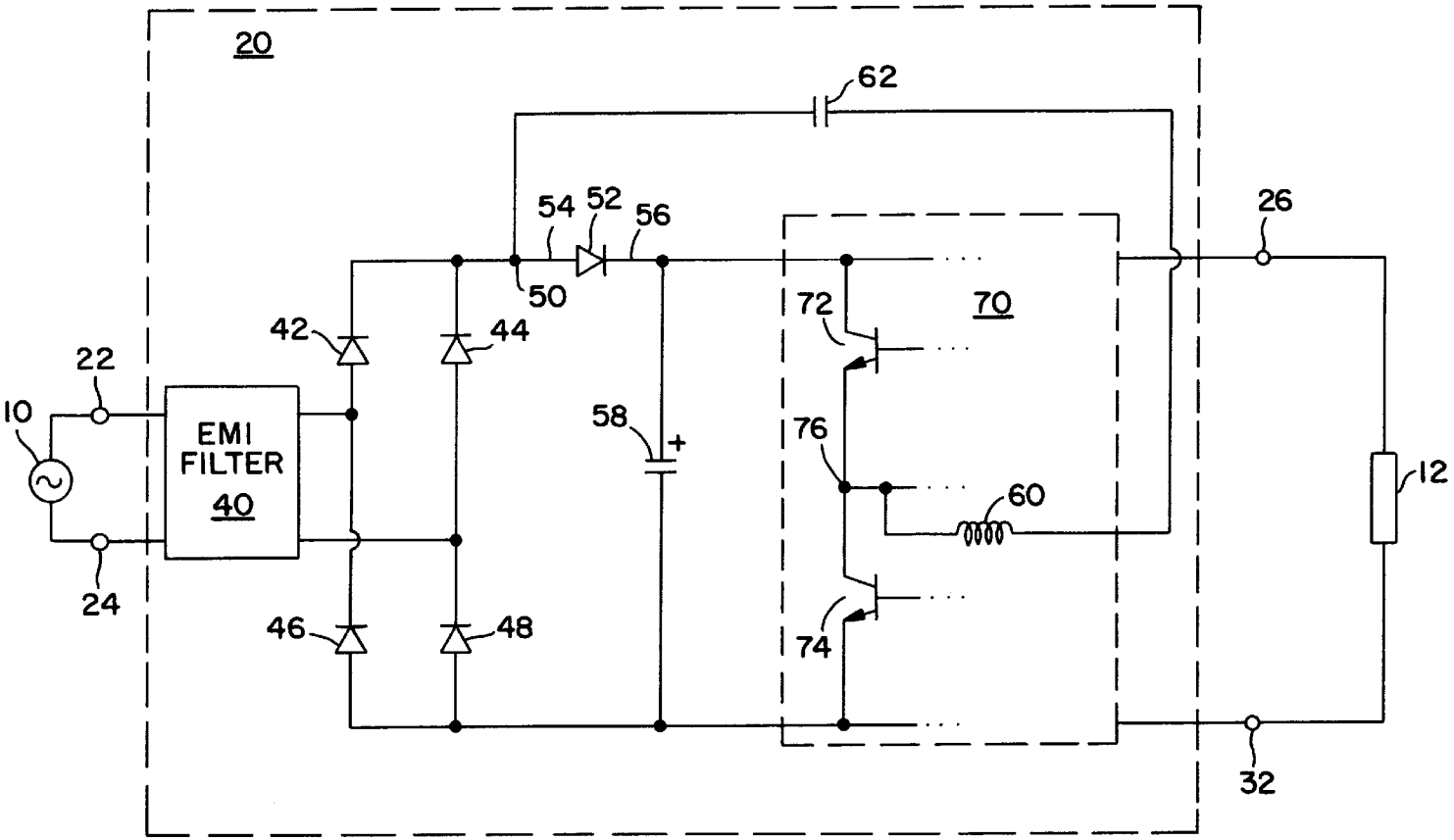
FIG. 1 PRIOR ART
FIG. 1 describes a known ballast with charge pump power factor correction, in accordance with the prior art.
Figure 2:
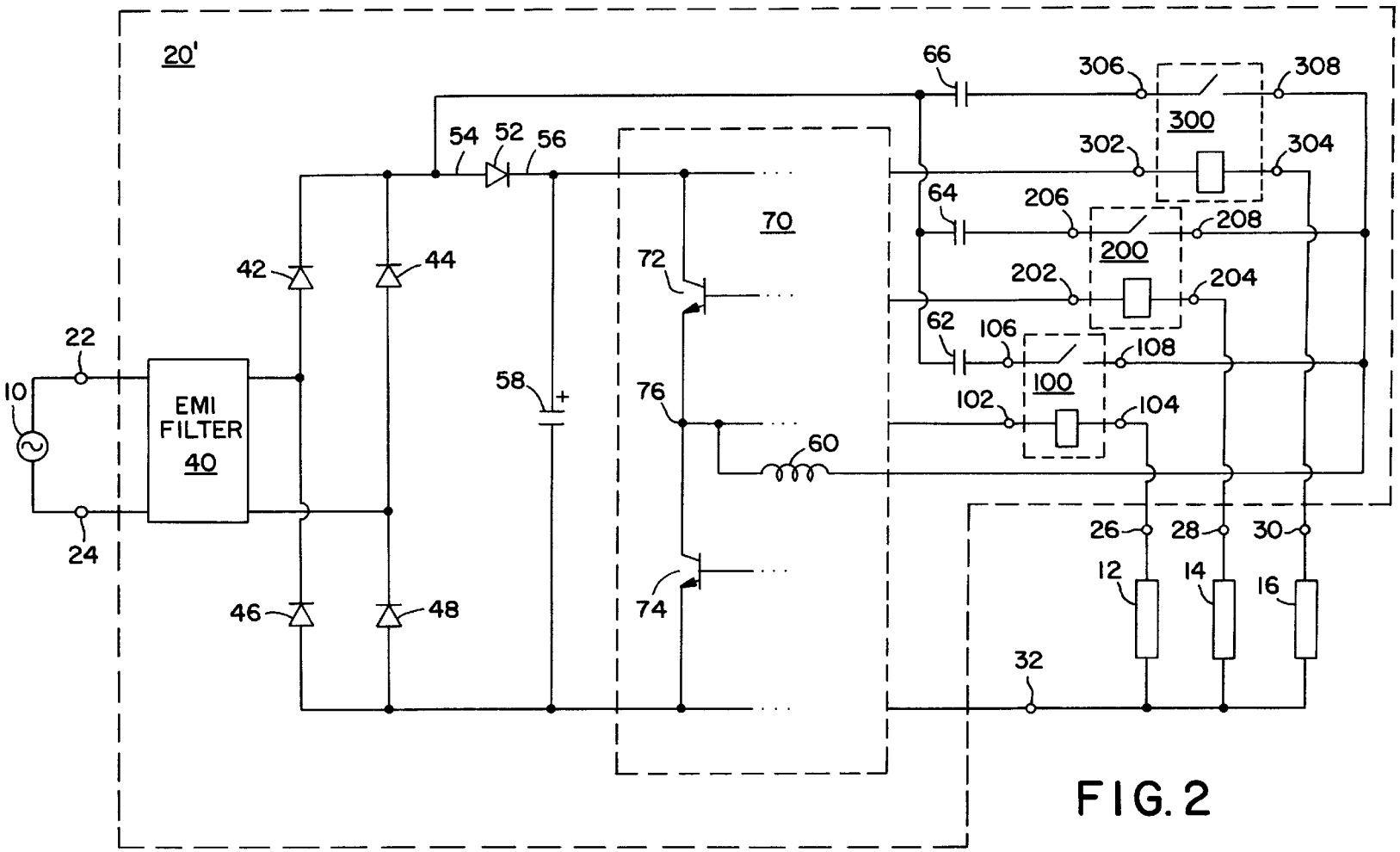
FIG. 2 describes a ballast with charge pump power factor correction, in accordance with a preferred embodiment of the present invention.

FIG. 2 describes a ballast 20' for powering three gas discharge lamps 12,14,16. Ballast 20' comprises a pair of input connections 22,24, a full-wave rectifier circuit 42,44,46,48, an energy-storage capacitor 58, an inverter 70, first, second, and third output connections 26,28,30, and a return path connection 32. Ballast 20' further comprises a charge pump arrangement that includes a charge pump rectifier 52, a charge pump inductor 60, first, second, and third charge pump capacitors 62,64,66, and first, second, and third switching elements 100,200,300.

Input connections 22,24 are adapted to receive a source of alternating current, such as 120 volts (rms) at 60 hertz. First, second, and third output connections 26,28,30 and return path connection 32 are adapted for connection to first, second, and third lamps 12,14,16; more specifically, first lamp 12 is connected between first output connection 26 and return path connection 32, second lamp 28 is connected between second output connection 28 and return path connection 32, and third lamp 16 is connected between third output connection 30 and return path connection 32. Full-wave rectifier circuit 42,44,46,48 is coupled to input connections 22,24 via EMI filter 40. Energy-storage capacitor 58 is coupled to the full-wave rectifier circuit via charge pump rectifier 52. Inverter 70 is coupled to the full-wave rectifier (via charge pump rectifier 52) and output connections 26,28,30,32.

Charge pump rectifier 52 has an anode 54 coupled to the full-wave rectifier, and a cathode 56 coupled to energy-storage capacitor 58 and inverter 70. Each switching element 100,200,300 has four terminals. The first terminal 102,202,302 of each switching element is coupled to inverter 70, while the second terminal 104,204,304 of each switching element is coupled to a corresponding output connection 26,28,30; that is, second terminal 104 (of switching element 100) is coupled to first output connection 26, second terminal 204 (of switching element 200) is coupled to second output connection 28, and second terminal 304 (of switching element 300) is coupled to third output connection 30. Charge pump inductor is coupled between inverter 70 and the fourth terminal 108,208,308 of each switching element 100,200,300. Finally, each charge pump capacitor 62,64,66 is coupled between the anode 54 of charge pump rectifier 52 and the third terminal 106,206,306 of its corresponding switching element 100,200,300.

Each switching element 100,200,300 is operable: (i) in response to a nonzero current flowing through its corresponding lamp, to couple the third terminal to the fourth terminal; and (ii) in response to substantially no current flowing through its corresponding lamp, to decouple the third terminal from the fourth terminal. For example, if first lamp 12 is operating, first switching element 100 will couple third terminal 106 to fourth terminal 108, thereby creating a circuit path by which first charge pump capacitor 62 feeds high frequency current back into the anode 54 of charge pump rectifier; on the other hand, if first lamp 12 is removed or failed, first switching element 100 will not coupled third terminal 106 to fourth terminal 108, thereby creating an open circuit that prevents first charge pump capacitor 62 from feeding back any high frequency current. The same relationships apply to the switching elements 200,300 and the charge pump capacitors 64,66 that are associated with the second and third lamps 14,16.

Switching elements 100,200,300 may be implemented via an electromagnetic relay that is internally configured in a "normally open" manner. That is, with no current flowing into first terminal 102 and out of second terminal 104, third and fourth terminals 106,108 are electrically decoupled (i.e., the "switch" between third and fourth terminals 106,108 is open); conversely, with current flowing into first terminal 102 and out of second terminal 104, third and fourth terminals 106,108 are electrically coupled (i.e., the "switch" between third and fourth terminals 106,108 is closed).

Ballast 20' provides a load-adaptable charge pump arrangement wherein the magnitude of the high frequency current that is injected into the anode of charge pump rectifier 52 is dependent on the number of operating lamps. As long as all three lamps 12,14,16 are present and operating, all three charge pump capacitors 62,64,66 will be connected. Consequently, the high frequency current that is fed back to the anode 54 of charge pump rectifier 52 will be at its maximum. If only two lamps are present and operating, only two of the three charge pump capacitors will be connected, and the amount of high frequency current that is fed back will be correspondingly less. As a consequence, the DC bus voltage will be prevented from significantly increasing following a reduction in the load. Along similar lines, if only one lamp is present and operating, the amount of current that is fed back will be even lower because only one charge pump capacitor remains connected. Finally, if no lamp remains present and operating, there will be no current fed back because all of the charge pump capacitors are then disconnected. In this way, switching elements 100,200,300 ensure that the amount of high frequency current that is fed back to charge pump rectifier 52 is reduced as lamps fail or are removed.

Figure 3:
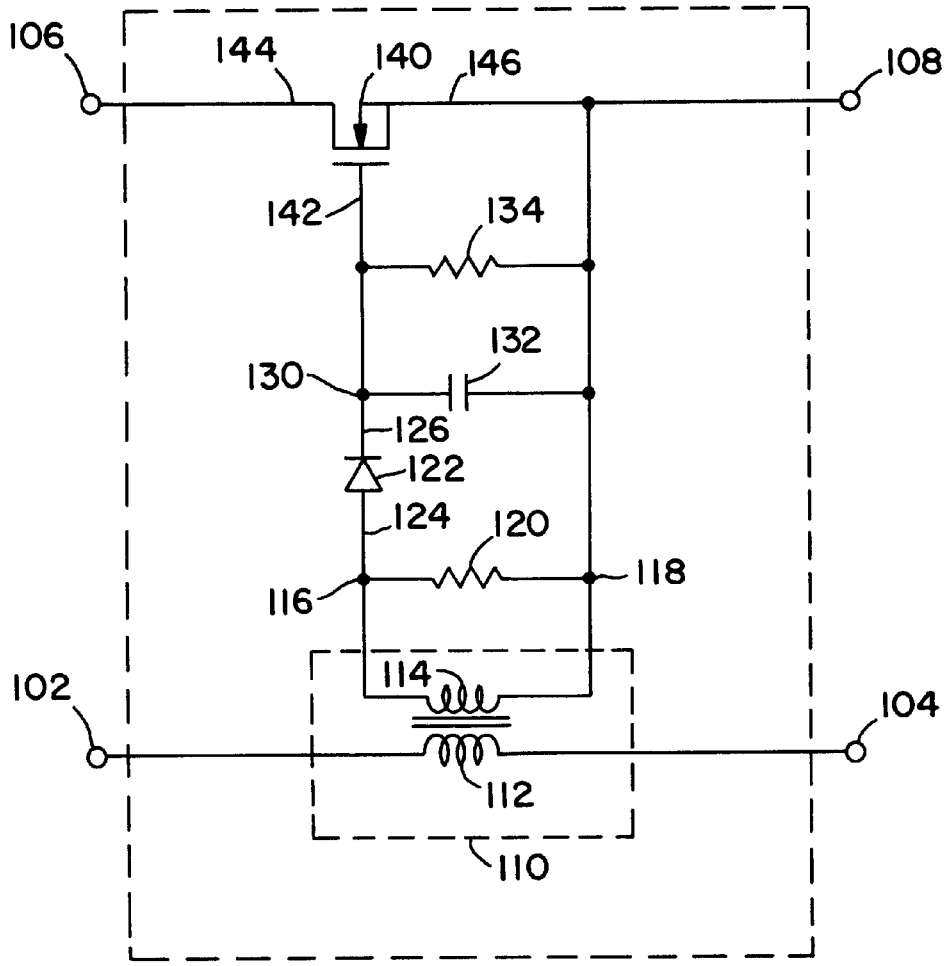
FIG. 3 describes a preferred circuit for implementing the switching elements in the ballast described in FIG. 2, in accordance with a preferred embodiment of the present invention.

As an alternative to implementation via an electromechanical relay, each switching element 100,200,300 may be implemented via a suitable electronic circuit arrangement, such as that which is illustrated in FIG. 3. As described in FIG. 3, the arrangement comprises a current transformer 110, a first resistor 120, a diode 122, a capacitor 132, a second resistor 134, and a voltage-controlled switch 140. Current transformer 110 has a primary winding 112 coupled between first terminal 102 and second terminal 104, and a secondary winding 114 coupled between a first node 116 and a common node 118; common node 118 is itself coupled to fourth terminal 108. First resistor 120 is coupled between first node 116 and common node 118. Diode 122 has an anode 124 coupled to first node 116, and a cathode 126 coupled to a second node 130. Capacitor 132 and resistor 134 are each coupled between second node 130 and common node 118. Voltage-controlled switch 140, which is preferably implemented as a field-effect transistor, has a gate coupled to second node 142, a drain 144 coupled to third terminal 106, and a source 146 coupled to fourth terminal 108.

During operation, the current that flows through first lamp 12 (see FIG. 2) also flows through primary winding 112. Thus, when first lamp 12 is present and conducting current, a nonzero current will flow through primary winding 112 and induce a voltage in secondary winding 114. The voltage across secondary winding 114 is peak-detected by diode 122 and capacitor 132, and then applied to the gate-source junction of transistor 140. This voltage (e.g., 10 volts or so) causes transistor 140 to turn on and effectively connect third terminal 106 to fourth terminal 108. If, on the other hand, first lamp 12 is not present or is not conducting current, zero current will flow through primary winding 112. Correspondingly, no voltage will be induced in secondary winding 114, so transistor 140 will be off and third terminal 106 will be effectively disconnected from fourth terminal 108.

A prototype ballast configured substantially as shown in FIG. 2 was built and tested. The AC line voltage was 277 volts at 60 hertz, the inverter operating frequency was set at 47 kilohertz, the capacitance of each charge pump capacitor was chosen to be 5.6 nanofarads, and the nominal load consisted of three 32 watt lamps. The DC bus voltage (Vbus), power factor (PF), total harmonic distortion (THD), and lamp current crest factor (CF) were measured under different load conditions. Those measurements are given below.

| # of lamps | Vbus (Vrms) | PF | THD (%) | CF |
|---|---|---|---|---|
| 3 | 415 | 0.986 | 2.89 | 1.65 |
| 2 | 412 | 0.974 | 8.96 | 1.60 |
| 1 | 380 | 0.924 | 23.0 | 1.52 |
| 0 | 379 | — | — | — |

It can thus be seen that ballast 20' accommodates parallel operation of multiple lamps in a reliable manner while still providing a useful degree of power factor correction in cases where one or more lamps is removed or failed.

Although the present invention has been described with reference to certain preferred embodiments, numerous modifications and variations can be made by those skilled in the art without departing from the novel spirit and scope of this invention. For instance, it should be appreciated that the principles and advantages of the present invention are generally applicable to ballasts with two or more lamps. For example, the circuitry illustrated in FIG. 2 can be modified to accommodate a fourth lamp simply by adding one additional output connection, switching element, and charge pump capacitor. Similarly, the circuitry in FIG. 2 can be modified to a two lamp ballast simply by omitting output connection 30, switching element 300, and charge pump capacitor 66. Moreover, although the principles of the present invention are most advantageously applied to ballasts that power multiple lamps, it is believed that they are also applicable to ballasts that power a single lamp.

What is claimed is:

1. A ballast for powering at least one gas discharge lamp, comprising:

a pair of input connections adapted to receive a source of alternating current;

a first output connection and a return path connection adapted for connection to a first gas discharge lamp;

a full-wave rectifier circuit coupled to the input connections;

an energy-storage capacitor operably coupled to the full-wave rectifier circuit;

an inverter circuit operably coupled between the full-wave rectifier and the output connections; and a charge pump arrangement, comprising:

a charge pump rectifier having an anode coupled to the full-wave rectifier circuit, and a cathode coupled to the energy-storage capacitor and the inverter;

a first switching element having a first terminal coupled to the inverter, a second terminal coupled to the first output connection, a third terminal, and a fourth terminal, wherein the first switching element is operable: (i) in response to a nonzero current flowing through the first lamp, to couple the third terminal to the fourth terminal; (ii) in response to substantially no current flowing through the first lamp, to decouple the third terminal from the fourth terminal;

a charge pump inductor coupled between the inverter node and the fourth terminal of the first switching element; and a first charge pump capacitor coupled between the anode of the charge pump rectifier and the third terminal of the first switching element.

2. The ballast of claim 1, wherein the first switching element is an electromechanical relay.

3. The ballast of claim 1, wherein the first switching element further comprises:

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a voltage-controlled switch having a gate coupled to the second node, a drain coupled to the third terminal, and a source coupled to the fourth terminal.

4. The ballast of claim 3, wherein the voltage-controlled switch is a field-effect transistor.

5. The ballast of claim 1, further comprising:

a second output connection adapted for connection to a second gas discharge lamp, wherein the second gas discharge lamp is coupled between the second output connection and the return path connection;

a second switching element having a first terminal coupled to the inverter, a second terminal coupled to the second output connection, a third terminal, and a fourth terminal coupled to the fourth terminal of the first switching element, wherein the second switching element is operable: (i) in response to a nonzero current flowing through the second lamp, to couple the third terminal to the fourth terminal; (ii) in response to substantially no current flowing through the second lamp, to decouple the third terminal from the fourth terminal; and a second charge pump capacitor coupled between the anode of the charge pump rectifier and the third terminal of the second switching element.

6. The ballast of claim 5, wherein the second switching element is an electromechanical relay.

7. The ballast of claim 5, wherein the second switching element further comprises:

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a voltage-controlled switch having a gate coupled to the second node, a drain coupled to the third terminal, and a source coupled to the fourth terminal.

8. The ballast of claim 7, wherein the voltage-controlled switch is a field-effect transistor.

9. The ballast of claim 5, further comprising:

a third output connection adapted for connection to a third gas discharge lamp, wherein the third gas discharge lamp is coupled between the third output connection and the return path connection;

a third switching element having a first terminal coupled to the inverter, a second terminal coupled to the third output connection, a third terminal, and a fourth terminal coupled to the fourth terminals of the first and second switching elements, wherein the third switching element is operable: (i) in response to a nonzero current flowing through the third lamp, to couple the third terminal to the fourth terminal; (ii) in response to substantially no current flowing through the third lamp, to decouple the third terminal from the fourth terminal; and a third charge pump capacitor coupled between the anode of the charge pump rectifier and the third terminal of the third switching element.

10. The ballast of claim 9, further comprising:

a fourth output connection adapted for connection to a fourth gas discharge lamp, wherein the fourth gas discharge lamp is coupled between the fourth output connection and the return path connection;

a fourth switching element having a first terminal coupled to the inverter, a second terminal coupled to the fourth output connection, a third terminal, and a fourth terminal coupled to the fourth terminals of the first, second, and third switching elements; and a fourth charge pump capacitor coupled between the anode of the charge pump rectifier and the third terminal of the fourth switching element.

11. A ballast for powering at least one gas discharge lamp, comprising:

a pair of input connections adapted to receive a source of alternating current;

a first output connection and a return path connection adapted for connection to a first gas discharge lamp;

a full-wave rectifier circuit coupled to the input connections;

an energy-storage capacitor operably coupled to the full-wave rectifier circuit;

an inverter circuit operably coupled between the full-wave rectifier and the output connections; and a charge pump arrangement, comprising:

a charge pump rectifier having an anode coupled to the full-wave rectifier circuit, and a cathode coupled to the energy-storage capacitor and the inverter;

a first switching element, comprising:

first, second, third, and fourth terminals, wherein the first terminal is coupled to the inverter and the second terminal is coupled to the first output connection;

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a voltage-controlled switch having a gate coupled to the second node, a drain coupled to the third terminal, and a source coupled to the fourth terminal;

a charge pump inductor coupled between the inverter node and the fourth terminal of the first switching element; and a first charge pump capacitor coupled between the anode of the charge pump rectifier and the third terminal of the first switching element.

12. The ballast of claim 11, wherein the voltage-controlled switch is a field-effect transistor.

13. The ballast of claim 11, further comprising:

a second output connection adapted for connection to a second gas discharge lamp, wherein the second gas discharge lamp is coupled between the second output connection and the return path connection;

a second switching element, comprising:

first, second, third, and fourth terminals, wherein the first terminal is coupled to the inverter, the second terminal is coupled to the second output connection, and the fourth terminal is coupled to the fourth terminal of the first switching element;

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a transistor having a gate coupled to the second node, a drain coupled to the third terminal, and a source coupled to the fourth terminal; and a second charge pump capacitor coupled between the anode of the charge pump rectifier and the third terminal of the second switching element.

14. The ballast of claim 13, further comprising:

a third output connection adapted for connection to a third gas discharge lamp, wherein the third gas discharge lamp is coupled between the third output connection and the return path connection;

a third switching element, comprising:

first, second, third, and fourth terminals, wherein the first terminal is coupled to the inverter, the second terminal is coupled to the second output connection, and the fourth terminal is coupled to the fourth terminals of the first and second switching elements;

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a transistor having a gate coupled to the second node, a drain coupled to the third terminal, and a source coupled to the fourth terminal; and a third charge pump capacitor coupled between the anode of the charge pump rectifier and the third terminal of the third switching element.

15. The ballast of claim 14, further comprising:

a fourth output connection adapted for connection to a fourth gas discharge lamp, wherein the fourth gas discharge lamp is coupled between the fourth output connection and the return path connection;

a fourth switching element, comprising:

first, second, third, and fourth terminals, wherein the first terminal is coupled to the inverter, the second terminal is coupled to the second output connection, and the fourth terminal is coupled to the fourth terminals of the first, second, and third switching elements;

a current transformer having a primary winding and secondary winding, wherein the primary winding is coupled between the first terminal and the second terminal, and the secondary winding is coupled between a first node and a common node, the common node being coupled to the fourth terminal;

a first resistor coupled between the first node and the common node;

a diode having an anode coupled to the first node and a cathode coupled to a second node;

a capacitor coupled between the second node and the common node;

a second resistor coupled between the second node and the common node; and a transistor having a gate coupled to the second node, a drain coupled to the third terminal, and a source coupled to the fourth terminal; and a fourth charge pump capacitor coupled between the anode of the charge pump rectifier and the third terminal of the fourth switching element.

16. A ballast for powering a plurality of gas discharge lamps, comprising:

a pair of input connections adapted to receive a source of alternating current;

a plurality of output connections and a return path connection adapted for connection to the plurality of gas discharge lamps, wherein each lamp is connected between its corresponding output connection and the return path connection;

a full-wave rectifier circuit coupled to the input connections;

an energy-storage capacitor operably coupled to the full-wave rectifier circuit;

an inverter circuit operably coupled between the full-wave rectifier and the output connections;

a charge pump rectifier having an anode coupled to the full-wave rectifier circuit, and a cathode coupled to the energy-storage capacitor and the inverter; and a load-adaptable charge pump arrangement coupled between the inverter, the output connections, and the anode of the charge pump rectifier, the charge pump arrangement being operable to inject a high frequency current into the anode of the charge pump rectifier, wherein the high frequency current has a magnitude that is dependent on the number of operating lamps present between the output connections and the return path connection.

* * * * *